US008298348B2

(12) United States Patent
Woo

(10) Patent No.: US 8,298,348 B2
(45) Date of Patent: Oct. 30, 2012

(54) DISH WASHER

(75) Inventor: Sang Woo Woo, Daegu (KR)

(73) Assignee: LG Electronics Inc., Seoul (KR)

( * ) Notice: Subject to any disclaimer, the term of this patent is extended or adjusted under 35 U.S.C. 154(b) by 994 days.

(21) Appl. No.: 11/790,439

(22) Filed: Apr. 25, 2007

(65) Prior Publication Data

US 2007/0251553 A1 Nov. 1, 2007

(30) Foreign Application Priority Data

Apr. 25, 2006 (KR) ..... 10-2006-0037006

(51) Int. Cl.
*B08B 3/00* (2006.01)

(52) U.S. Cl. ..... 134/56 D; 134/57 D

(58) Field of Classification Search ..... None
See application file for complete search history.

(56) References Cited

U.S. PATENT DOCUMENTS 5,618,416 A * 4/1997 Haefner ..... 210/163
7,464,720 B2 12/2008 Yoon et al.
2005/0109871 A1* 5/2005 Mitchell et al. ..... 242/590
2005/0268948 A1 12/2005 Jeong
2006/0060228 A1* 3/2006 Yoon et al. ..... 134/56 D
2006/0118148 A1* 6/2006 Jeong et al. ..... 134/58 D

FOREIGN PATENT DOCUMENTS

CN 2591379 * 12/2003
CN 2591379 Y 12/2003
CN 1701750 A 11/2005

* cited by examiner

*Primary Examiner* — Michael Barr
*Assistant Examiner* — Jason Ko
(74) *Attorney, Agent, or Firm* — Birch, Stewart, Kolasch & Birch, LLP

(57) ABSTRACT

A dish washer is provided. In the dish washer, a tub forms a cleaning chamber, and a sump is disposed at a lower portion of the tub and stores wash water. An injection nozzle injects the wash water stored in the sump into the cleaning chamber. A water guide guides the wash water from the sump to the nozzle. A first coupling mechanism is used to couple a portion of the water guide to the sump. A second coupling mechanism is used to couple another portion of the water guide to the sump.

13 Claims, 6 Drawing Sheets

DISH WASHER

The present application claims priority under 35 U.S.C. 119 and 35 U.S.C. 365 to Korean Patent Application No. 10-2006-0037006 (filed on Apr. 25, 2006), which is hereby incorporated by reference in its entirety.

BACKGROUND

1. Field

This disclosure relates to a dish washer for cleaning food dishes and eating utensils.

2. Description of the Related Art

Generally, dish washers are used for removing dirty and remaining food from food dishes and eating utensils (hereinafter, collectively referred to as dishes) by injecting wash water onto the dishes at a high pressure.

Such a dish washer includes a tub forming a cleaning chamber and a sump disposed at a lower portion of the tub for storing wash water. A cleaning pump is installed in the sump to pump the wash water to an injection nozzle connected to the sump. The wash water arrived at the injection nozzle is injected through a nozzle hole formed in an end of the injection nozzle at a high pressure. Two injection nozzles can be disposed at upper and lower portions of the tub, respectively, and the upper injection nozzle can be connected to the sump by a water guide.

SUMMARY

The implementation of the dish washer is provided. The dish washer includes a tub forming a cleaning chamber; a sump disposed at a lower portion of the tub and storing wash water; an injection nozzle injecting the wash water stored in the sump into the cleaning chamber; a water guide guiding the wash water from the sump to the nozzle; a first coupling mechanism used to couple a portion of the water guide to the sump; and a second coupling mechanism used to couple another portion of the water guide to the sump.

DETAILED DESCRIPTION

Figure 1:
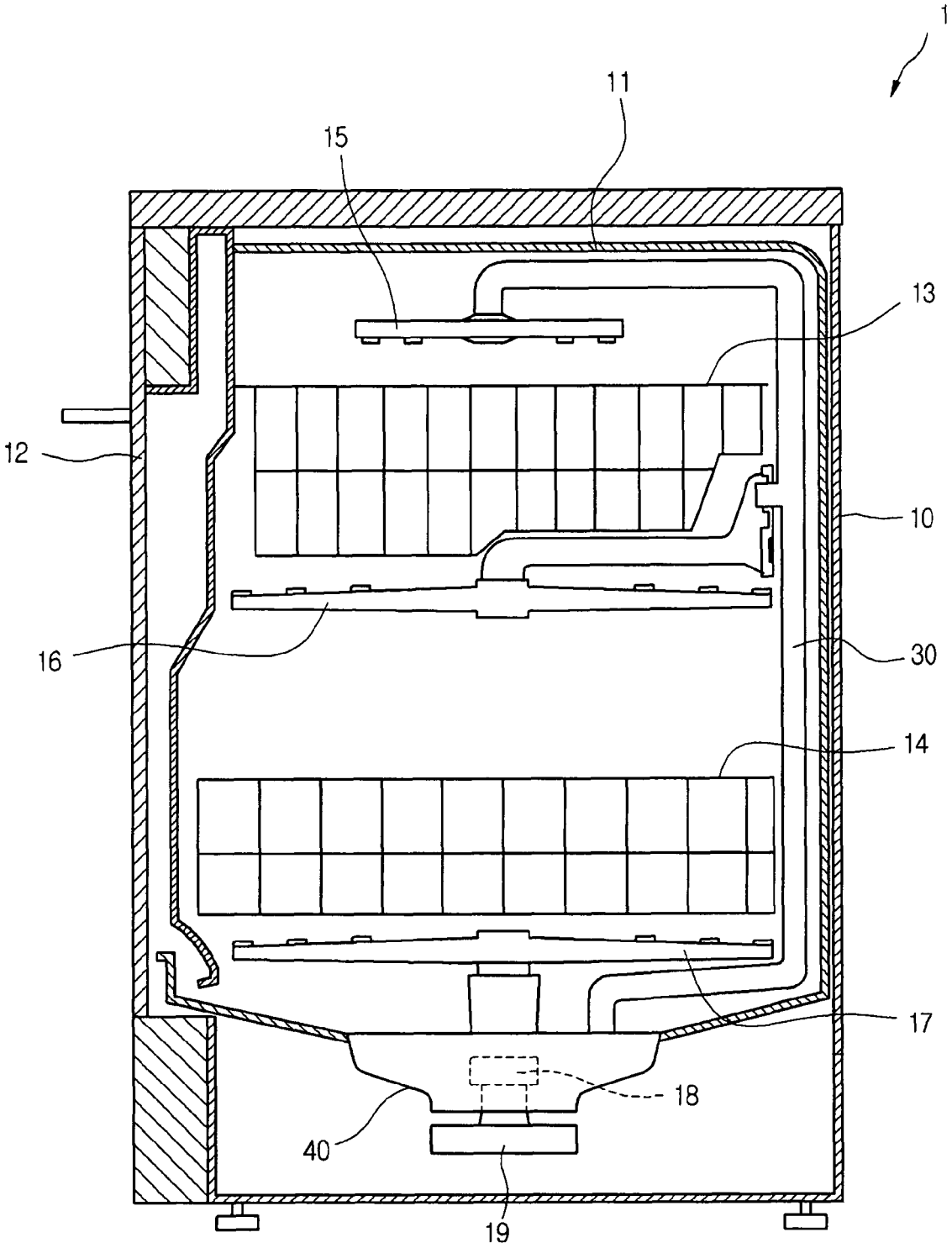
FIG. 1 is a cross-sectional view illustrating a dish washer.

FIG. 1 is a cross-sectional view illustrating a dish washer 1.

Referring to FIG. 1, the dish washer 1 includes a case 10 forming the exterior of the dish washer 1, a tub 11 disposed in the case 10 for forming a cleaning chamber, a door 12 formed at a front portion of the tub 11 for selectively opening and closing the tub 11, and a sump 40 disposed at a bottom center portion of the tub 11 for storing wash water.

The dish washer 1 further includes a cleaning pump 18 pumping wash water stored in the sump 40 at a high pressure, and a driving motor 19 coupled to the cleaning pump 18 for driving the cleaning pump 18.

In detail, an upper rack 13, a lower rack 14, a top nozzle 15, an upper nozzle 16, and a lower nozzle 17 are disposed in the tub 11. The upper and lower racks 13 and 14 are used to place dishes and can be slid out from the tub 11. The top, upper, and lower nozzles 15, 16, and 17 are used to inject wash water onto the upper and lower racks 13 and 14.

The lower nozzle 17 is disposed under the lower rack 14 and is connected to an upper center portion of the sump 40. Wash water is injected upward through the lower nozzle 17.

The top and upper nozzles 15 and 16 receives wash water from the sump 40 through a water guide 30. The water guide 30 is a pipeline through which wash water flows from the sump 40 to the top and upper nozzles 15 and 16.

The upper nozzle 16 is disposed between the upper and lower racks 13 and 14 and injects wash water toward the upper rack 13. The top nozzle 15 is disposed above the upper rack 13 and injects wash water toward the upper rack 13.

Hereinafter, an operation of the dish washer 1 will be described.

First, a user opens the door 12 of the dish washer 1 and pulls out one or both of the upper and lower racks 13 and 14 forward from the tub 11. Then, the user places dishes on the upper and lower racks 13 and 14.

Next, the user pushes the upper and lower racks 13 and 14 back to the tub 11 and closes the door 12. Then, the user turns on the dish washer 1 to operate the dish washer 1.

When the dish washer 1 is turned on, the dish washer operates in cleaning mode. In detail, wash water is introduced into the sump 40 and is pumped to the lower nozzle 17 and the water guide 30. Wash water pumped to the water guide 30 is distributed to the top and upper nozzles 15 and 16. Here, wash water is pumped to the lower nozzle 17 and the water guide 30 in an alternating manner at predetermined intervals.

The wash water pumped to the lower, upper, and top nozzles 17, 16, and 15 is injected on to the dishes placed on the upper and lower racks 13 and 14 for cleaning the dishes.

Thereafter, the dish washer 1 operates in rinsing mode to rinse the dishes using clean water. Next, the dish washer 1 operates in dry mode.

Figure 2:
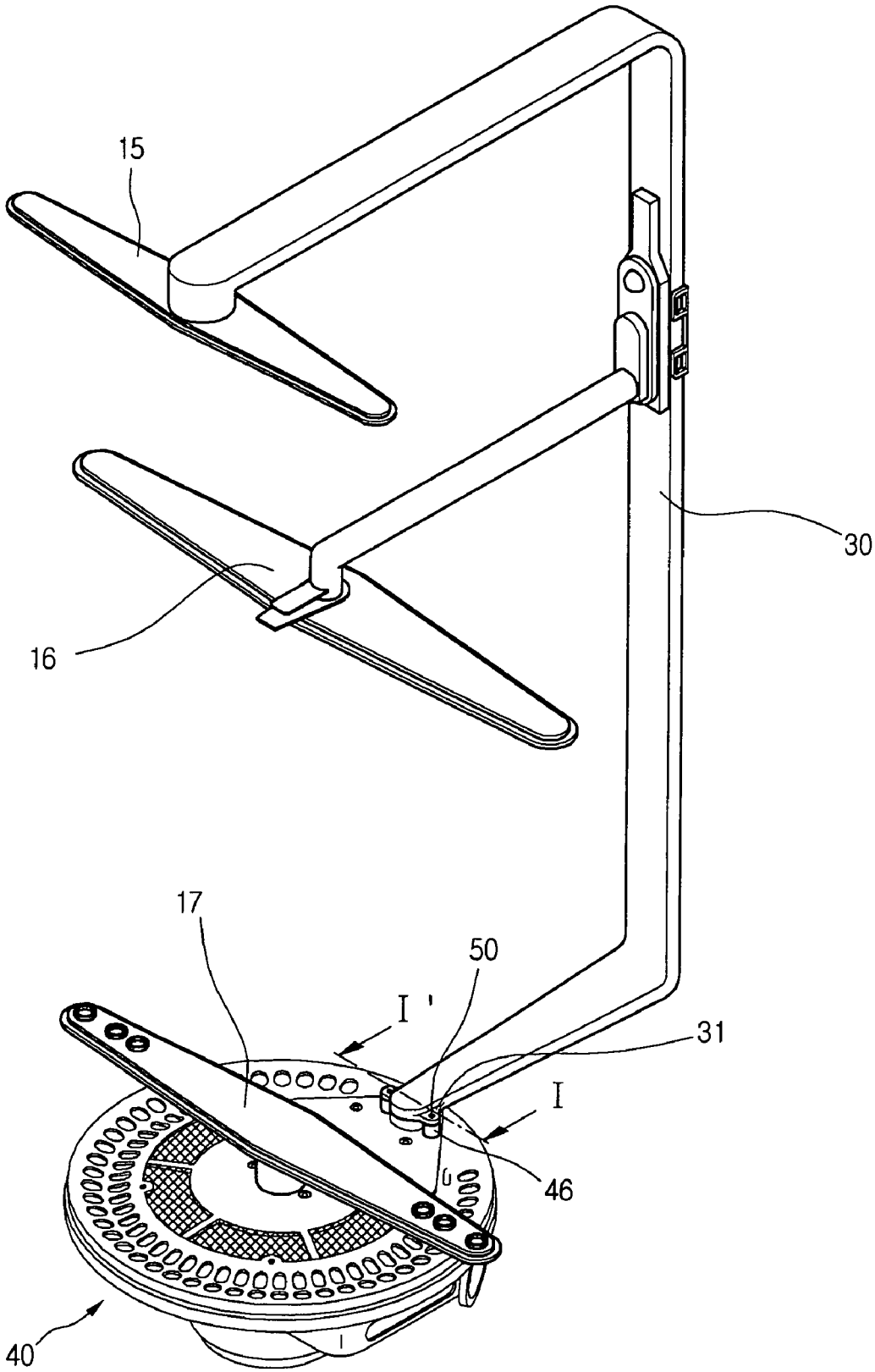
FIG. 2 is a perspective view illustrating a sump and a water guide that are guide coupled to each other.
Figure 3:
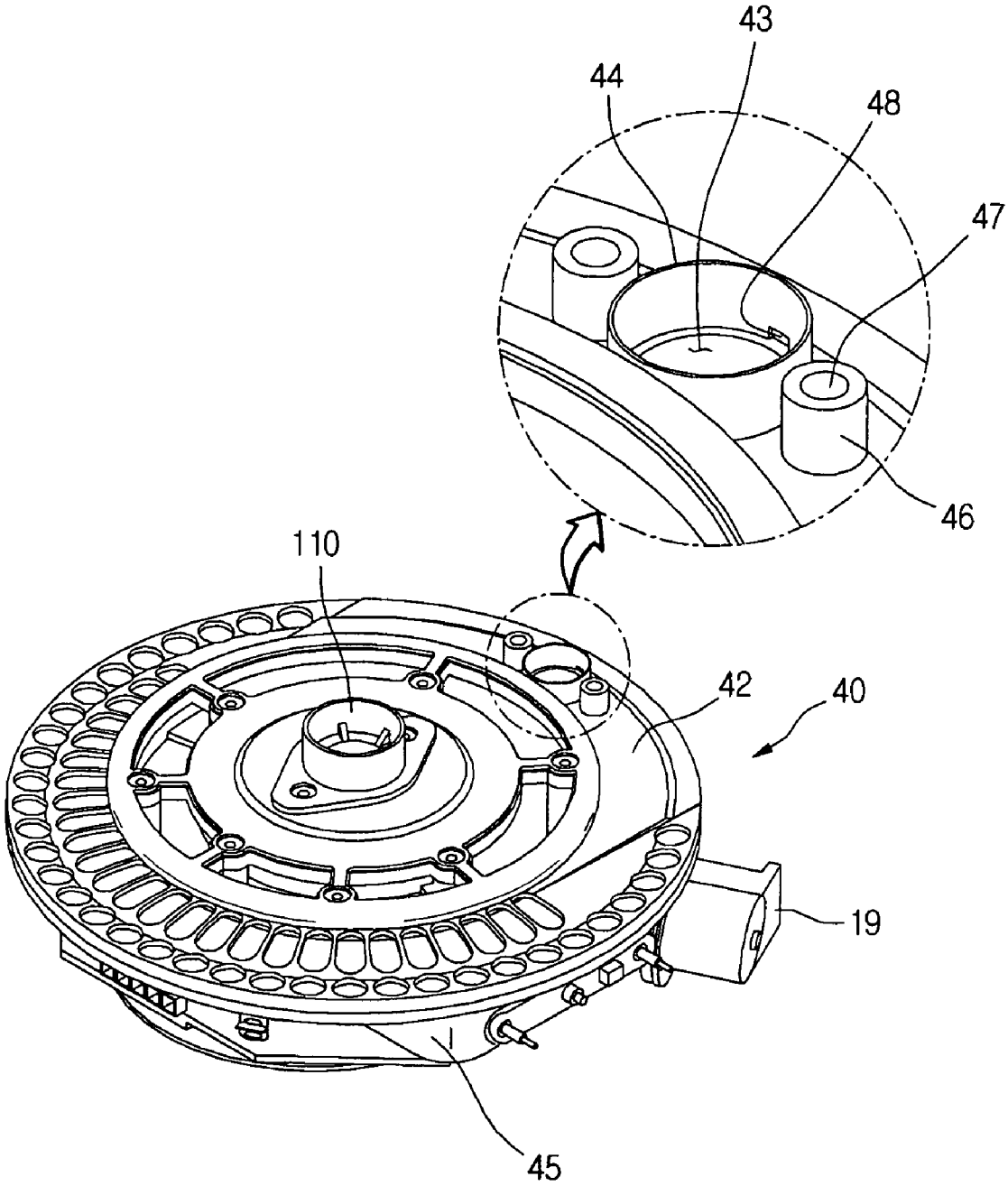
FIG. 3 is a perspective view illustrating the sump from which the water guide is separated.
Figure 4:
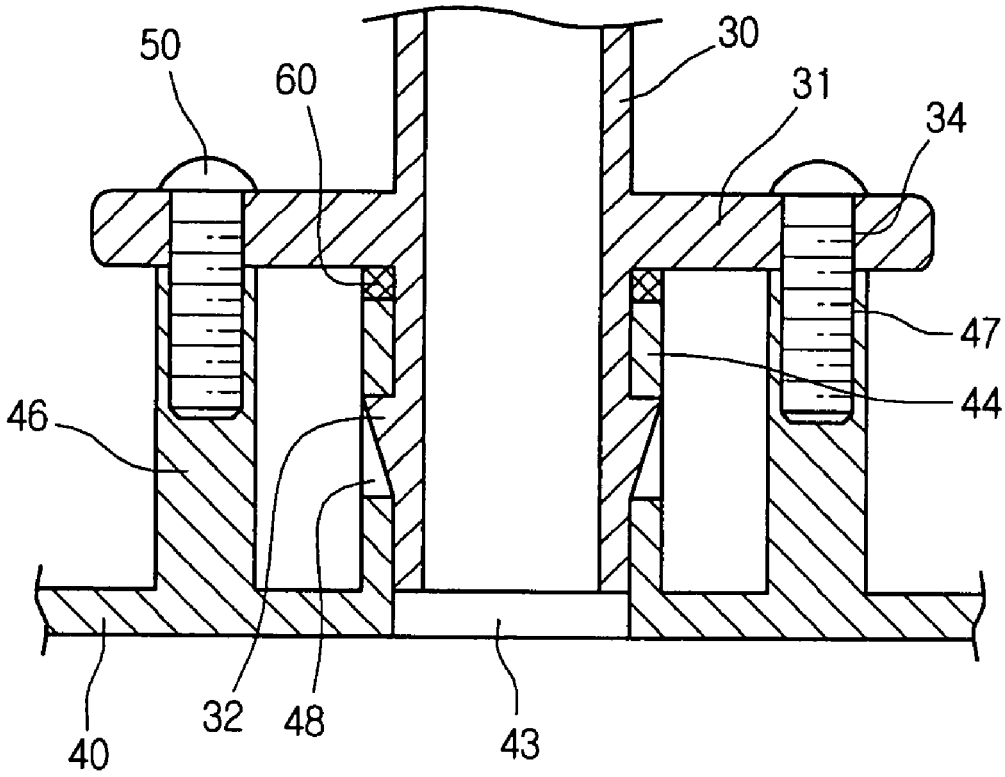
FIG. 4 is a sectional view taken along line I-I' of FIG. 2.

FIG. 2 is a perspective view illustrating the sump 40 and the water guide 30 that are guide coupled to each other, FIG. 3 is a perspective view illustrating the sump 40 from which the water guide 30 is separated, and FIG. 4 is a sectional view taken along line I-I' of FIG. 2.

Referring to FIGS. 2 to 4, a lower end of the water guide 30 is coupled to an upper edge of the sump 40.

Approximately, the water guide 30 is ]-shaped. The upper nozzle 16 is connected to a vertical portion of the water guide 30, and the top nozzle 15 is connected to a horizontal portion of the water guide 30 bent from an upper end of the vertical portion. The lower nozzle 17 is connected to a center portion of the sump 40.

In detail, the sump 40 includes a sump case 45 storing wash water and a sump cover 42 covering the top of the sump case 45.

A supply hole 43 is formed in an edge portion of the sump cover 42. Wash water is discharged from the sump 40 to the water guide 30 through the supply hole 43. A water guide connection 44 is formed around the supply hole 43 to a predetermined height. The water guide connection 44 has a cylindrical shape to receive the lower end of the water guide 30.

The water guide connection 44 includes at least one hook insertion hole 48 to receive a hook 32 of the water guide 30.

Therefore, when the lower end of the water guide 30 is inserted into the water guide connection 44, the hook 32 is coupled to the hook insertion hole 48.

A sealing member 60 is disposed on the top of the water guide connection 44 to provide sealing between the water guide connection 44 and the lower end of the water guide 30. Therefore, leakage of wash water can be prevented.

A pair of second coupling parts 46 is formed at both sides of the water guide connection 44. The second coupling parts 46 extend from a top surface of the sump cover 42 upward to a height corresponding to the height of the water guide connection 44. The second coupling parts 46 include coupling holes 47 to receive fastening members 50.

The lower end of the water guide 30 has a cylindrical shape with an outer diameter corresponding to an inner diameter of the water guide connection 44.

The hook 32 is formed on the lower end of the water guide 30. After the lower end of the water guide 30 is inserted into the water guide connection 44, the lower end of the water guide 30 can be stable fixed owing to the hook 32.

The water guide 30 and the sump 40 can be first coupled by inserting the lower end of the water guide 30 into the water guide connection 44 to couple the hook 32 to the hook insertion hole 48. The hook 32 and the hook insertion hole 48 can be referred to as a first coupling mechanism.

A pair of first coupling parts 31 is formed at both sides of the lower end of the water guide 30 as part of the water guide 30. The number of the first coupling parts 31 is two in the current embodiment. However, the number of the first coupling parts 31 can vary.

When the water guide 30 is coupled to the water guide connection 44, the first coupling parts 31 are placed on top of the second coupling parts 46. In other words, the second coupling parts 46 support the first coupling parts 31.

Alternatively, the first coupling parts 31 can be placed on side portions of the second coupling parts 46. In this state, the fastening members 50 can be used to couple the first and second coupling parts 31 and 46.

That is, when the first coupling parts 31 are placed on top of the second coupling parts 46, the fastening members 50 may be vertically inserted into the first and second coupling parts 31 and 46. However, when the first coupling parts 31 are placed on side portions of the second coupling parts 46, the fastening members 50 may be horizontally inserted into the first and second coupling parts 31 and 46.

The first coupling parts 31 include coupling holes 34 to receive the fastening members 50. Therefore, when the first coupling parts 31 are placed on top of the second coupling parts 46, the fastening members 50 can be inserted into the first and second coupling parts 31 and 46 for fixedly coupling the first and second coupling parts 31 and 46.

Since the fastening members 50 are inserted into the coupling holes 34 and 47, the coupling holes 34 and 47 may be formed at corresponding positions.

In the current embodiment, the first coupling parts 31 and the second coupling parts 46 are coupled using the fastening members 50. In this way, the water guide 30 can be secondarily coupled to the sump 40. Thus, the fastening members 50, the first coupling parts 31, and the second coupling parts 46 can be referred to as a second coupling mechanism.

In the current embodiment, the water guide 30 and the sump 40 are firmly fixed to each other by the first and second coupling mechanisms, such that undesired separation of the water guide 30 from the sump 40 can be reliably prevented.

Furthermore, since the lower end of the water guide 30 is firmly coupled to the water guide connection 44, wash water does not leak through an interface between the water guide 30 and the sump 40.

Figure 5:
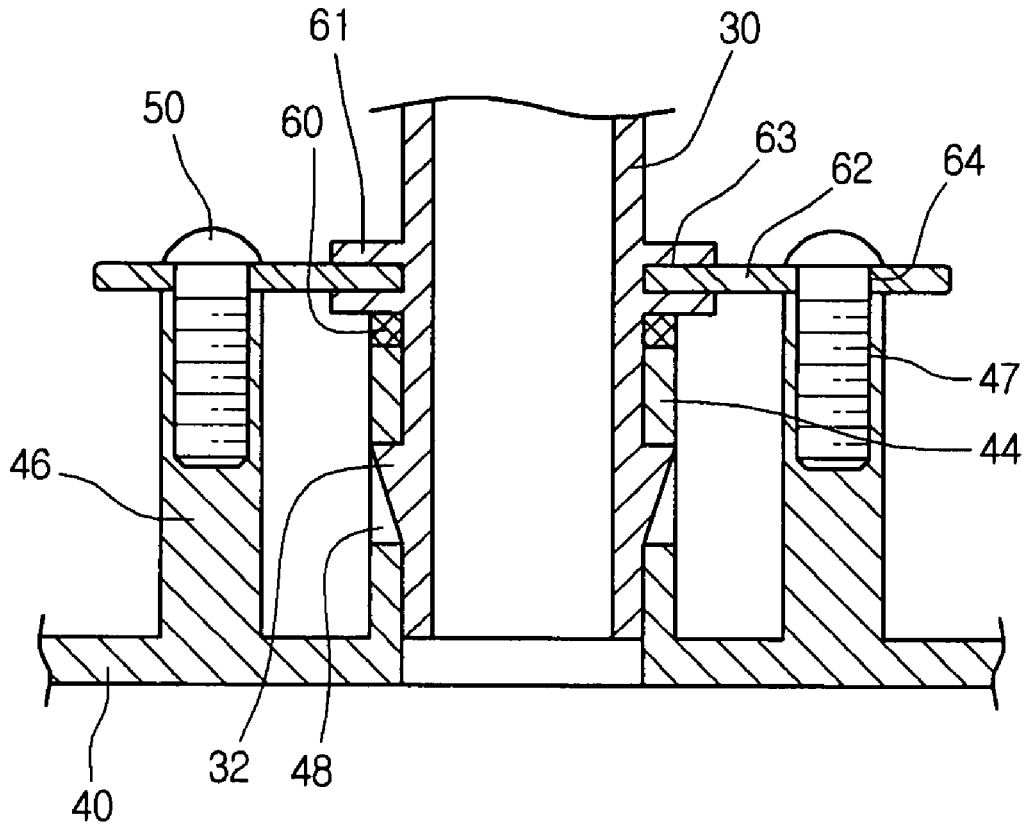
FIG. 5 is a sectional view taken along line I-I' of FIG. 2, according to another implementation of a dish washer.

FIG. 5 is a sectional view taken along line I-I' of FIG. 2, according to another implementation of the dish washer.

Referring to FIG. 5, a water guide 30 of the current embodiment includes first coupling parts 62 coupled to the second coupling parts 46. The first coupling parts 62 are inserted into coupling holders 61 formed on an outer surface of the water guide 30.

In detail, the coupling holders 61 include grooves 63 for receiving the first coupling parts 62, and the first coupling parts 62 include coupling holes 64 for receiving the fastening members 50. The coupling holes 64 are formed at positions corresponding to the positions of the coupling holes 47 of the second coupling parts 46.

In the current embodiment, since the first coupling parts 62 are inserted into the grooves 63 and are coupled to the second coupling parts 46, an additional member is not required to coupling the first coupling parts 62 to the coupling holders 61.

Figure 6:
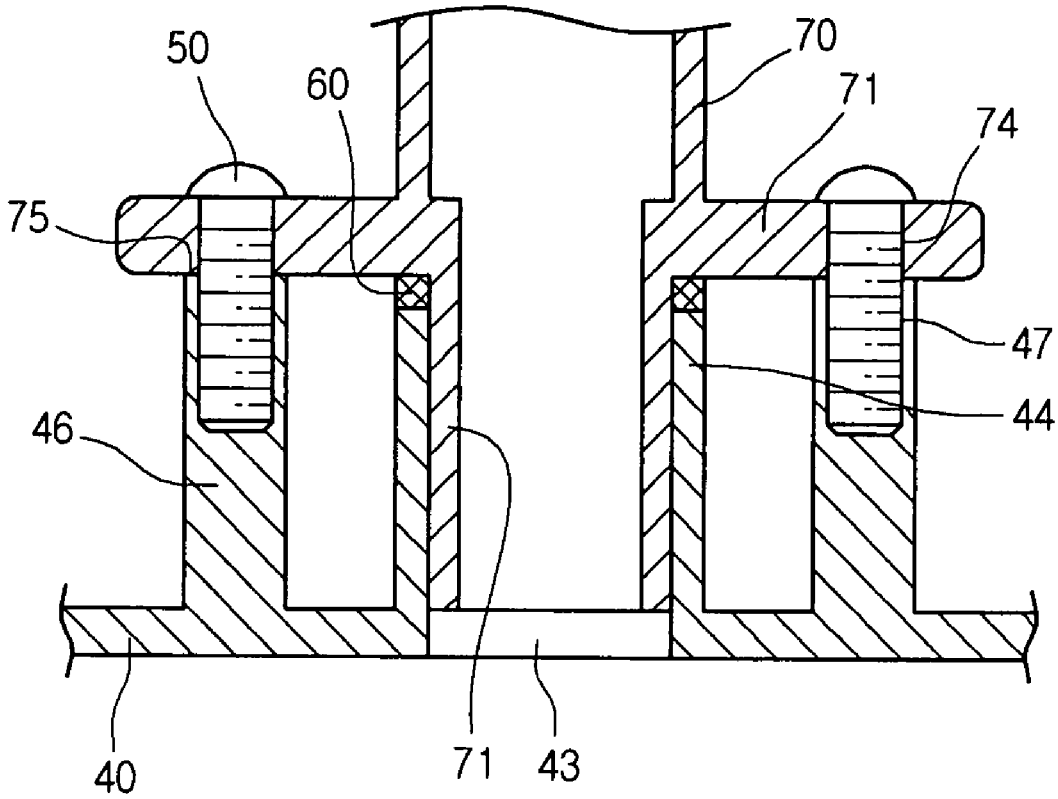
FIG. 6 is a sectional view taken along line I-I' of FIG. 2, according to further another implementation of a dish washer.

FIG. 6 is a sectional view taken along line I-I' of FIG. 2, according to further another implementation of the dish washer.

Referring to FIG. 6, a water guide 70 of the current embodiment includes an insertion portion 71 at a lower end. The insertion portion 71 is inserted into the water guide connection 44. The insertion portion 71 has a smaller diameter than that of other portion of the lower end of the water guide 70.

A pair of first coupling parts 72 is formed on upper side of the insertion portion 71. The first coupling parts 72 are coupled to the second coupling parts 46 by the fastening members 50.

That is, in the current embodiment, the water guide 70 is fixed to the sump 40 by coupling the first coupling parts 72 to the second coupling parts 46 using the fastening members 50.

Here, the first coupling parts 72 includes guide portions 75 at bottom surfaces to facilitate alignment of coupling holes 74 of the first coupling parts 72 with the coupling holes 47 of the second coupling parts 46. That is, when the insertion portion 71 is inserted into the water guide connection 44, portions of the second coupling parts 46 are inserted into the guide portions 75 such that the coupling holes 74 can be easily aligned with the coupling holes 47.

What is claimed is:

1. A dish washer comprising:

a tub forming a cleaning chamber;

a sump disposed at a lower portion of the tub and storing wash water;

a lower nozzle injecting the wash water stored in the sump into the cleaning chamber;

a lower nozzle coupling part provided at the sump and to which the lower nozzle is coupled;

an upper nozzle injecting the wash water stored in the sump into the cleaning chamber;

a water guide guiding the wash water from the sump to the upper nozzle;

a first coupling mechanism used to couple a portion of the water guide to the sump; and a second coupling mechanism used to couple another portion of the water guide to the sump, wherein the first coupling mechanism comprises a water guide connection protruded from the sump, and wherein a lower end of the water guide is inserted into the water guide connection, wherein the first coupling mechanism comprises at least one hook formed on the water guide, wherein the second coupling mechanism comprises:

a first coupling part protruded from an outer surface of the water guide; and a second coupling part protruded from the sump for coupling with the first coupling part, the second coupling part and the sump being formed as one body, and the second coupling part extending upwardly from the sump, wherein the second coupling part is spaced apart from the water guide connection, wherein the first coupling part is disposed above the hook, wherein the first coupling part is seated on the second coupling part when the lower end of the water guide is inserted into the water guide connection, and wherein the first and second coupling parts comprise coupling holes, a fastening member inserted through the coupling holes without passing through the sump.

2. The dish washer according to claim 1, wherein the water guide connection comprises a hook insertion hole for receiving the hook.

3. The dish washer according to claim 1, further comprising a sealing member disposed between the water guide and the water guide connection for preventing leakage of wash water.

4. The dish washer according to claim 1, wherein a plurality of second coupling parts are formed at the sump around the water guide connection.

5. The dish washer according to claim 1, wherein the first coupling part comprises a guide portion guiding the second coupling part when the first and second coupling parts are coupled to each other.

6. The dish washer according to claim 1, wherein the first coupling part is formed as an integral part of the water guide.

7. The dish washer according to claim 1, wherein the water guide comprises a coupling holder as an integral part for coupling with the first coupling part.

8. The dish washer according to claim 7, wherein the coupling holder comprises a groove for receiving the first coupling part.

9. A dish washer comprising:

a sump storing wash water;

a lower nozzle injecting the wash water stored in the sump into the cleaning chamber;

a lower nozzle coupling part provided at the sump and to which the lower nozzle is coupled;

an upper nozzle injecting the wash water stored in the sump into the cleaning chamber;

a water guide guiding the wash water from the sump to the upper nozzle;

a water guide connection protruding from the sump and connected to a portion of the water guide; and a coupling mechanism used to couple an additional portion of the water guide to the sump, wherein the water guide is provided with at least one hook, wherein the coupling mechanism comprises:

a first coupling part protruded from an outer surface of the water guide; and a second coupling part protruded from the sump for coupling with the first coupling part, the second coupling part and the sump formed as one body, and the second coupling part extending upwardly from the sump, wherein the second coupling part is spaced apart from the water guide connection, wherein the first coupling part is disposed above the hook, wherein the first coupling part is seated on the second coupling part when the lower end of the water guide is inserted into the water guide connection, and wherein the first and second coupling parts comprise coupling holes, a fastening member inserted through the coupling holes without passing through the sump.

10. The dish washer according to claim 9, wherein the water guide connection comprises a hook insertion hole for receiving the hook.

11. The dish washer according to claim 9, wherein the second coupling part is formed near the water guide connection to a predetermined height for coupling with the first coupling part.

12. The dish washer according to claim 11, wherein the first coupling part is placed at a top portion of the second coupling part when the water guide is connected to the water guide connection.

13. A dish washer comprising:

a sump storing wash water, the sump including a sump case storing wash water and a sump cover at an upper side of the sump case;

a supply hole formed at the sump cover to discharge the wash water;

a water guide connection protruded from the sump cover;

a water guide connected to the water guide connection for receiving the wash water, the water guide having at least one hook;

an upper nozzle connected to the water guide;

a lower nozzle connected to the sump cover and provided under the upper nozzle;

a first coupling part formed at an outer surface of the water guide; and a second coupling part protruding from the sump cover at a position close to the supply hole for coupling with the first coupling part, the second coupling part and the sump formed as one body, and the second coupling part extending upwardly from the sump, wherein the first coupling part is disposed above the hook, wherein the first coupling part is seated on the second coupling part when the water guide is inserted into the water guide connection, and wherein the first and second coupling parts comprise coupling holes, a fastening member inserted through the coupling holes without passing through the sump.

* * * * *